US008381334B2

(12) United States Patent
Ballard

(10) Patent No.: US 8,381,334 B2
(45) Date of Patent: Feb. 26, 2013

(54) TRAVEL QUILT WITH RETAINMENT MEANS

(76) Inventor: Cheri Ballard, Shabbona, IL (US)

( * ) Notice: Subject to any disclaimer, the term of this patent is extended or adjusted under 35 U.S.C. 154(b) by 0 days.

(21) Appl. No.: 13/220,322

(22) Filed: Aug. 29, 2011

(65) Prior Publication Data

US 2012/0073048 A1 Mar. 29, 2012

Related U.S. Application Data

(60) Provisional application No. 61/386,624, filed on Sep. 27, 2010.

(51) Int. Cl.
*A47G 9/02* (2006.01)

(52) U.S. Cl. ..... 5/502; 5/485; 5/486; 5/655

(58) Field of Classification Search ..... 5/417, 482, 5/485, 486, 496, 502, 655, 907; 446/71; 112/408, 420, 440, 441; D6/603
See application file for complete search history.

(56) References Cited

U.S. PATENT DOCUMENTS 2,078,022 A * 4/1937 Roemer ..... 446/227
4,125,903 A 11/1978 Farrell
4,949,415 A * 8/1990 Selga ..... 5/502
5,208,934 A * 5/1993 Bachnick et al. ..... 5/482
5,540,609 A * 7/1996 Hoag ..... 446/26
6,233,763 B1 5/2001 Spaan
6,684,422 B2 2/2004 LeFevre
RE38,782 E * 8/2005 Dix ..... 5/482
7,107,638 B2 * 9/2006 Wilson ..... 5/502
2004/0199998 A1 10/2004 Shinner
2007/0087657 A1 * 4/2007 Campbell et al. ..... 446/482
2010/0263122 A1 * 10/2010 Papen et al. ..... 5/502

* cited by examiner

*Primary Examiner* — Michael Trettel
(74) *Attorney, Agent, or Firm* — Daniel Boudwin

(57) ABSTRACT

A combination quilt and article retention means for transporting and storing loose items attached thereon, particularly suited for providing a baby blanket and retention device for baby toys and similar articles. The quilt comprises a plurality of square patches upon which are provided retention straps for securing baby articles thereto. A pocket is provided for larger items or for those items not suitable for strap retention. The quilt is collapsible into a folded state, wherein a transportable structure is provided that is of reduced surface area, while the retained articles are secured within the interior of the blanket. The size of the quilt is suited for fitment into a standard sized baby crib, while the straps and pouch provide a means to secure various items while traveling with a baby outside of the home.

6 Claims, 2 Drawing Sheets

TRAVEL QUILT WITH RETAINMENT MEANS

CROSS REFERENCE TO RELATED APPLICATION

This application claims the benefit of U.S. Provisional Application No. 61/386,624 filed on Sep. 27$^{th}$, 2010, entitled "Toy Travel Quilt."

BACKGROUND OF THE INVENTION

1. Field of the Invention

The present invention relates to foldable blankets and article retention structures. More specifically, the present invention relates to a combination quilt and article retention device that provides a means to secure loose articles to the blanket for improved storage, transportation and organization. Of particular emphasis is a combination baby bedspread, baby changing blanket or similar item in conjunction with a baby toy, diaper or food article retention means.

2. Description of the Prior Art

Individuals traveling with a multitude of loose items can sometimes find it difficult to pack both a blanket and all articles into a single container. Further, these items may require an upright stance to prevent leakage of interior contents. Parents of young children are quite often confronted with this occurrence, wherein a child requires several toys, a diaper bag, food or beverages, and other various articles that are necessary when leaving the household on short trips. Most parents use a diaper bag to store all items; however this container can quickly become cluttered and messy, making it difficult to locate specific items. Food and beverages are also not easily transported with this type of bag, as they are prone to spill within the bag during transport.

The present invention provides a combination quilt or blanket with a plurality of retention means. The blanket provides regions along its surface from which are supported strap retention means and a pocket region for securing loose items. Baby items such as toys, pacifiers, and sippy cups may be secured via the straps, while items such as diapers, shoes and formula bottles may be supported within the pocket region. Once all items are loaded and secured, the blanket folds onto itself to reduce its size, while the items are wrapped within the interior of the folded blanket. The blanket in its folded state may be stored in an upright position, thereby allowing any liquid-containing bottles stored within the pouch region to remain similarly upright.

Several devices have been described in the art for carrying loose articles, including those that attempt to combine a blanket and an article carrying means. These devices have familiar design elements for the purposes of carrying items, however they share similar drawbacks. While they provide novel means for accomplishing their respective requirements, they fail to provide a device that provides retainment of articles through strap retainers and a pouch region that is attached to a blanket structure, and one that is collapsible into a condensed state.

U.S. Published Patent Application No. 2004/0199998 to Shinner describes a convertible blanket that may be used as a blanket only, a blanket with a storage compartment or holder for a pillow, or finally a blanket that may be used as a sleeping bag. In a sleeping bag arrangement, the periphery of the blanket is provided with a zipper closure to open the blanket to utilize the invention as a double-sided blanket and sleeping bag enclosure. While capable of providing multiple uses as a blanket, the elements of the Shinner patent application do not describe the elements of the present invention, namely a blanket with article attachment means, along with a pocket for use in carrying multiple items within the blanket.

U.S. Pat. No. 6,233,763 to Spaan describes an improved blanket comprising an attached pocket for housing an amusement figure therein. The pocket provides a cavity to house and transport articles, and in particular a child's toy. A button housed within the interior cavity of the pocket provides a means to retain the article therein. This device describes a blanket with a pocket for holding a toy, which falls short of fully disclosing the present invention. The present invention provides a pocket for retention of articles, along with a series of straps for securing further items along a first surface of the blanket. The blanket also provides closure straps for folding and condensing the blanket into a smaller area and enclosing articles retained therein.

U.S. Pat. No. 4,125,903 to Farrell describes a baby blanket of rectangular shape, having a triangular front panel section covering approximately one-half of the surface area along one side of the blanket. The triangular section may serve as a pocket or retainer for baby products, wherein the top edge of the pocket spans the diagonal of the rectangle. This blanket, similar to the Spaan patent, describes a blanket that incorporates a pocket storage means. The structure and means of securing articles differs from the present invention.

U.S. Pat. No. 6,684,422 to LeFevre describes a toy and article retention blanket wherein a plurality of pockets and tie down structures are affixed. The blanket provides a means to secure baby articles while traveling, allowing the child to play with the toys or access specific articles without the risk of dropping the same onto a dirty surface. The blanket is specifically designed for stimulating a child's tactile sense by allowing the child to reach for and grasp articles retained on the blanket surface. The blanket further provides a blanket surface retention system for attaching the assembly to a child conveyance device. The LeFerve device is one that is intended to be suspended from a structure and allow access to or create tactile stimulation from retained articles. It is not designed to be used as storage means for a plurality of articles, as described by the present invention.

The present invention provides a baby quilt with means for attaching various articles thereto. Strap retention means on the surface of the quilt provide secure retention of loose articles, while a pocket provides retention of articles not easily retained by the straps alone. For storage and transport, the quilt can be folded and tied into a compact form. The present invention substantially diverges in design elements from the prior art, consequently it is clear that there is a need in the art for an improvement to existing combination blanket and baby article retention devices. In this regard the instant invention substantially fulfills these needs.

SUMMARY OF THE INVENTION

In view of the foregoing disadvantages inherent in the known types of blanket and article retention means now present in the prior art, the present invention provides a new blanket quilt wherein the same can be utilized for providing convenience for the user when storing and transporting loose articles within the interior of a folded quilt, and for retaining articles to the surface thereof when unfolded.

It is therefore an object of the present invention to provide a new and improved blanket quilt and article retention device that has all of the advantages of the prior art and none of the disadvantages.

Another object of the present invention is to provide a quilt that provides a plurality of loose article retention straps and a pouch along its surface for securing loose articles thereto.

Another object of the present invention is to provide a combination quilt and article retention device that is capable of folding onto itself to reduce its size and envelope articled secured thereto.

Another object of the present invention is to provide a quilt with a plurality of patches sewn together and framed in a connected border. The size of the blanket allows for its use as a crib blanket, a baby changing blanket or similar baby related covering. The elements of the quilt, most notably the length and design of the retention straps, meet Federal child safety guidelines for the protection of babies and young children.

Yet another object of the present invention is to provide a quilt and retention device specifically suited for baby articles.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
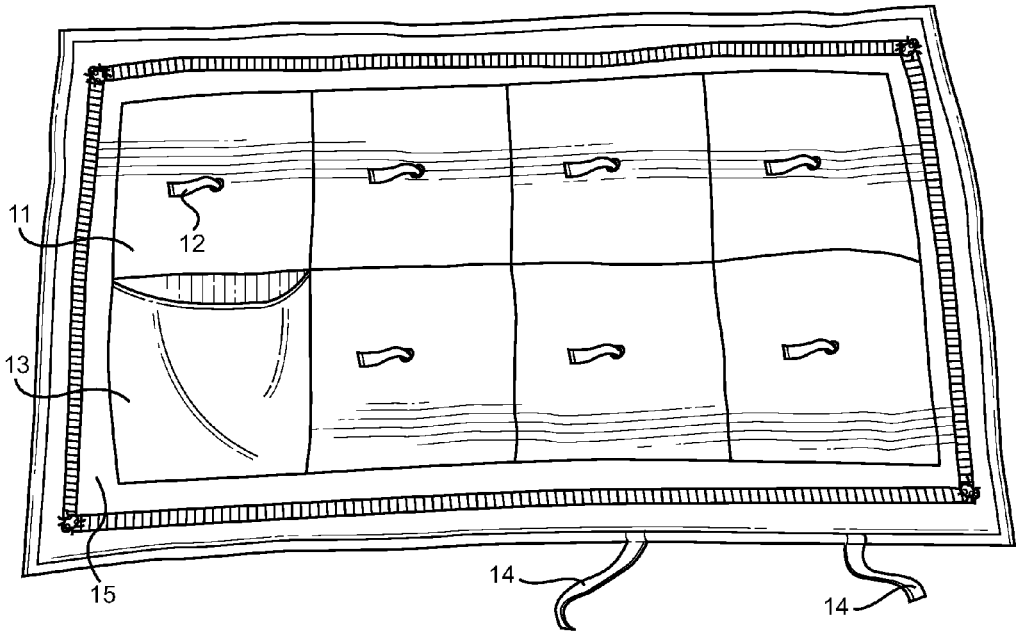
FIG. 1 shows a front view of the present invention.

Referring now to FIG. 1, there is shown a front view of the present invention, wherein a quilted blanket is provided with a plurality of patches 11. Each patch is sewn to an adjoining patch or to a surrounding border 15 that extends around the perimeter of the blanket. At the center of each patch is provided a buttonhole that is reinforced with stitching to provide tear resistance. The buttonholes provide a location for which to secure a retaining strap means 12 therethrough. A knot is placed at a first end of the strap 12, while the second, free end is slid through the buttonhole. The knot bears against the buttonhole, which subsequently resists pull-through. From this position, the strap 12 free end provides a means to wrap around an article and secure the same to the surface of a particular patch 11. One or more patches may alternatively be provided in the form of a pocket 13, which provides support and containment for larger items, or for those items that are difficult to secure using a strap 12. Two closure straps 14 are provided along a lower quadrant of the blanket, and provide a means to secure the device when folded into a collapsed state.

Figure 2:
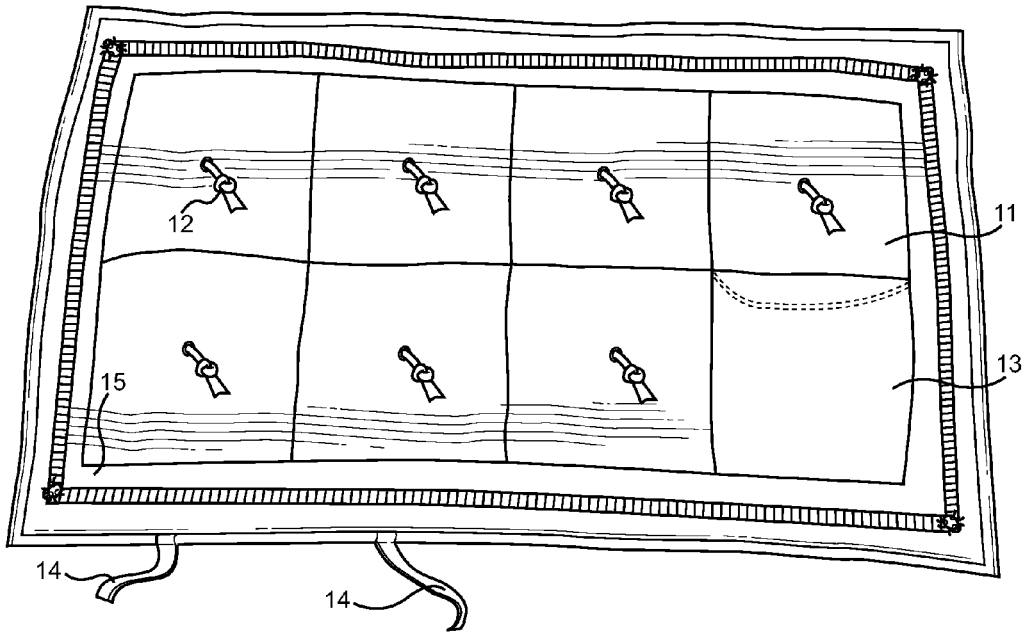
FIG. 2 shows a back view of the present invention.

Referring now to FIG. 2, there is shown a backside view of the present invention, wherein the back of each patch 11 is visible. The straps 12 are placed through buttonholes on each patch and secured using an overhand knot, or similar knot to prevent strap pull through. A plurality of straps may be attached to the quilt as necessary, or a user may choose to utilize the quilt as a cover or blanket without straps. This provides a device with inherent modularity, allowing its use for several different purposes or tasks. The quilt can be used as a blanket for a baby crib, as a baby changing blanket, as a baby ground cover, or alternatively as a means for retaining articles that are otherwise placed into a diaper bag. In the latter, the quilt provides a clean, organized way of retaining articles, while minimizing the number of carry-all items or alternate bags used to shuttle necessary baby articles. These articles include toys, diapers, pacifiers, bottles and other items.

The blanket itself comprises a quilted fabric outer material of two layers, preferably a cotton material or cotton blend thereof, providing a soft layer for which to place a baby or to use as a covering therefor. The quilt outer material encloses an inner batting material for improved comfort and padding, which comprises a water proof material that prevents liquid from soaking into the batting or from seeping through the thickness of the quilt and onto a working surface. The fabrics used to construct the quilt are machine washable, thus allowing users to easy clean a soiled or used quilt. The materials and dimensions of the quilt and associated straps align with Federal child safety regulations, thus preventing introduction of dangerous products around children. This requirement is carried through all elements of the present invention, including material suitability with regard to flammability and ingestion risk. The straps are limited to a specific length to eliminate any strangulation risk to a young child or baby.

Figure 3:
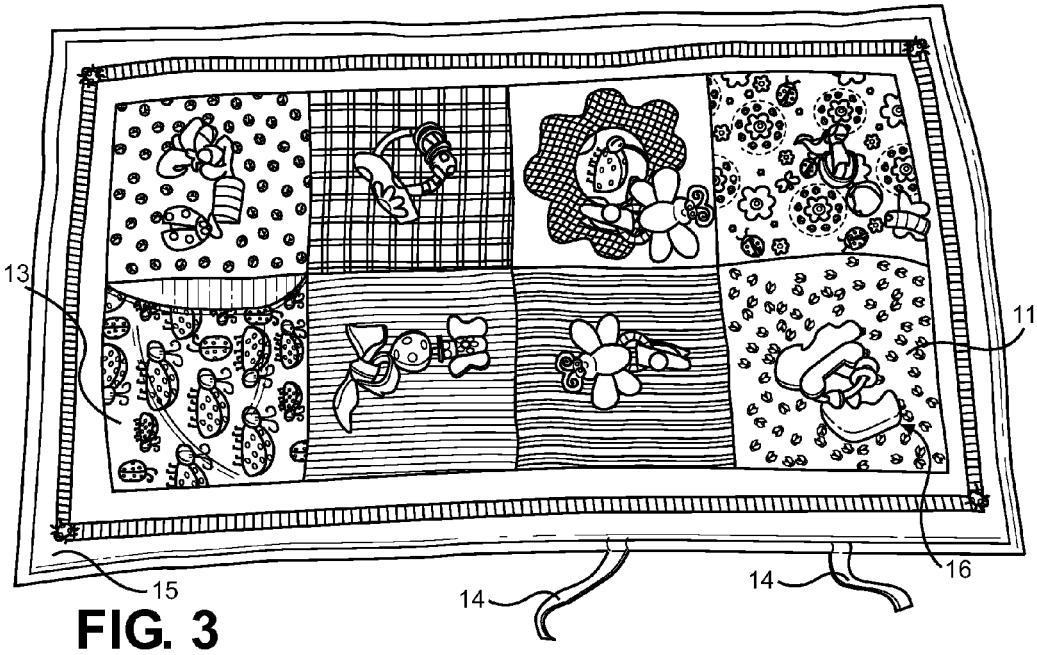
FIG. 3 shows an embodiment of the present invention wherein a pattern is provided and toys are affixed to the strap retention means.

Referring now to FIG. 3, there is shown an embodiment of the present invention that includes a series of patterns for each patch 11 of the quilt. The quilt is also shown in its open, working position, wherein several baby toys 16 are secured to corresponding patches 11 utilizing the retention straps. The straps wrap around and tie to a section of each toy to secure it to a particular patch 11, while the knot at its first end provides a means to secure the toy to the patch at the buttonhole location. The color, pattern and design on the quilt may be tailored to suit user preferences, while the overall size of the quilt and the associated patches is likewise dependent upon user requirements and preferences.

Figure 4:
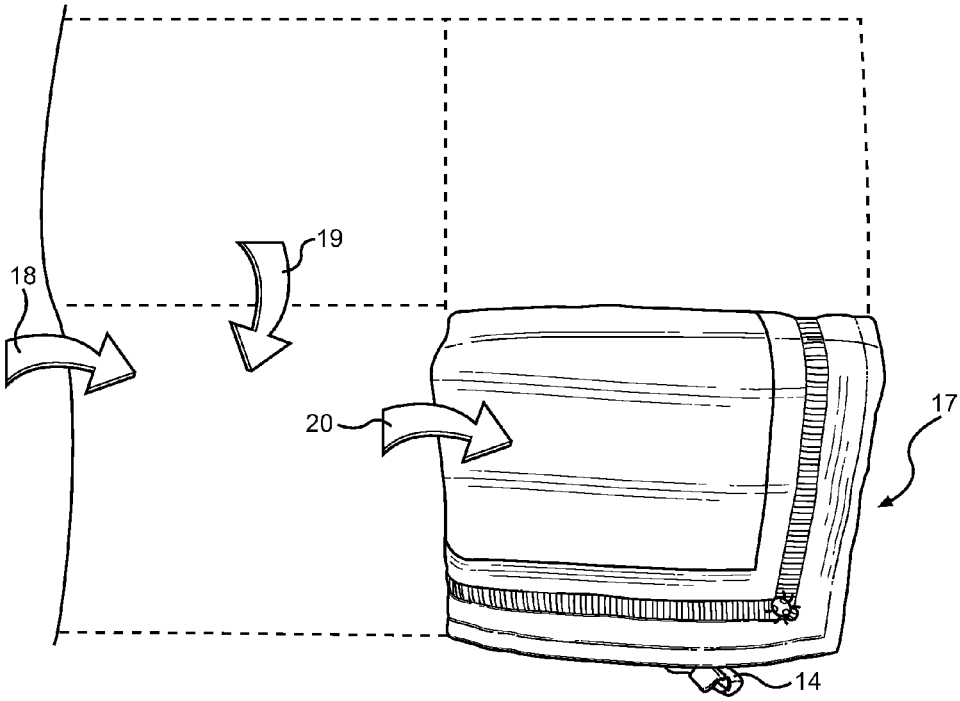
FIG. 4 shows the present invention in its collapsed state.

Referring now to FIG. 4, there is shown a view of the present invention in its collapsed state 17. The quilt can be folded onto itself, using stitch lines between patches as fold lines, to provide a device that is collapsible and one that can secure several items within its interior when folded. As shown, the quilt is first folded in half 18, then halved again 19, and finally collapsed into its final form 20. A set of closure straps 14 provide a means to secure the quilt in its collapsed state, securing items enclosed within and improving transportability.

In use an individual utilizes the present invention as a combination baby quilt and baby article retention means, and one that can eliminate the use of several bags when traveling outside of the home with a child. The child's toys, food, diapers, bottles, pacifiers and other similar articles can either be secured using the straps means or placed in the supplied pocket. Articles containing liquid can be placed into the pouch and kept in an upright position after the quilt is folded into a collapsed state. Alternate embodiments of the strap retention means include the use of two buttonholes, side-by-side, with a single strap that weaves through both holes and is tied around an article for retention thereof. A further embodiment utilizes a strap with a supplied button along its length for use in retaining the strap in the single buttonhole. This embodiment replaces the need for as user to tie a knot at the first end of the strap.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A combination blanket quilt and article retention means, comprising:

a plurality of patches sewn together to form a quilt, bounded by a surrounding border;

said patches comprising either a centrally located buttonhole or a pocket flap;

a set of closure straps attached to said border;

a plurality of retention straps with a first end having a means for engaging with a buttonhole and a second free end;

said second free end adapted for securing to loose articles, said first end adapted to bear against said buttonhole;

said quilt adapted to fold into a collapsed state and secured using said closure straps.

2. A device as in claim 1, wherein said means for engaging with a buttonhole comprises an overhand knot of said strap.

3. A device as in claim 1, wherein said means for engaging with a buttonhole comprises a button along said strap length.

4. A device as in claim 1, wherein said quilt patches comprise two outer layers of quilted fabric and an interior space filled with batting material, said batting material being waterproof.

5. A combination blanket quilt and article retention means, comprising:

a plurality of patches sewn together to form a quilt, bounded by a surrounding border;

said patches comprising either two centrally located buttonholes or a pocket flap;

a set of closure straps attached to said border;

a plurality of retention straps with a first end adapted to weave through said buttonholes and engage a second free end to secure to an article;

said quilt adapted to fold into a collapsed state and secured using said closure straps.

6. A device as in claim 5, wherein said quilt patches comprise two outer layers of quilted fabric and an interior space filled with batting material, said batting material being waterproof.

* * * * *